US008160888B2

(12) United States Patent
Breebaart et al.

(10) Patent No.: US 8,160,888 B2
(45) Date of Patent: Apr. 17, 2012

(54) GENERATION OF MULTI-CHANNEL AUDIO SIGNALS

(75) Inventors: Dirk Jeroen Breebaart, Eindhoven (NL); Lars Falck Villemoes, Jarfalla (SE); Heiko Purnhagen, Sundbyberg (DE); Christof Faller, Chavannes-Pres-Renens (CH)

(73) Assignees: Koninklijke Philips Electronics N.V, Eindhoven (NL); Conding Technologies AB, Stockholm (SE); Agere Systems, Allentown, PA (US)

( * ) Notice: Subject to any disclaimer, the term of this patent is extended or adjusted under 35 U.S.C. 154(b) by 1081 days.

(21) Appl. No.: 11/995,700

(22) PCT Filed: Jul. 12, 2006

(86) PCT No.: PCT/IB2006/052368

§ 371 (c)(1),
(2), (4) Date: Jan. 15, 2008

(87) PCT Pub. No.: WO2007/010451

PCT Pub. Date: Jan. 25, 2007

(65) Prior Publication Data

US 2008/0201153 A1 Aug. 21, 2008

(30) Foreign Application Priority Data

Jul. 19, 2005 (EP) ..... 05106612

(51) Int. Cl.
*G10L 19/00* (2006.01)

(52) U.S. Cl. ..... 704/500

(58) Field of Classification Search ..... 704/230, 704/500–504, 130; 381/98, 93.3
See application file for complete search history.

(56) References Cited

U.S. PATENT DOCUMENTS 6,131,084 A 10/2000 Hardwick (Continued)

FOREIGN PATENT DOCUMENTS

RU 2214048 C2 2/2000

(Continued)

OTHER PUBLICATIONS

Russian Decision on Grant, mailed Oct. 25, 2010 in related Russian Patent Application No. 2008106223, 5 pages.

(Continued)

*Primary Examiner* — Abul Azad

(74) *Attorney, Agent, or Firm* — Glenn Patent Group; Michael A. Glenn

(57) ABSTRACT

A decoder (115) generates a multi channel audio signal, such as a surround sound signal, from a received first signal. The multi-channel signal comprises a second set of audio channels and the first signal comprises a first set of audio channels. The decoder (115) comprises a receiver (401) which receives the first signal. The receiver (401) is coupled to an estimate processor (405) which generates estimated parametric data for the second set of audio channels in response to characteristics of the first set of audio channels. The estimated parametric data relates characteristics of the second set of audio channels to characteristics of the first set of audio channels. The decoder (115) furthermore comprises a spatial audio decoder (403) which decodes the first signal in response to the estimated parametric data to generate the multi-channel signal comprising the second set of channels. The invention allows use of spatial audio decoding with signals that are not encoded by a spatial audio encoder.

18 Claims, 6 Drawing Sheets

U.S. PATENT DOCUMENTS

| | | | | |
|---|---|---|---|---|
| 6,529,604 | B1 | 3/2003 | Park et al. | |
| 6,823,018 | B1 | 11/2004 | Jafarkhani et al. | |
| 7,394,903 | B2 * | 7/2008 | Herre et al. | 381/23 |
| 2003/0040822 | A1 | 2/2003 | Eid | |
| 2004/0091118 | A1 | 5/2004 | Griesinger | |
| 2005/0058304 | A1 * | 3/2005 | Baumgarte et al. | 381/98 |
| 2006/0165184 | A1 * | 7/2006 | Purnhagen et al. | 375/242 |
| 2006/0239473 | A1 * | 10/2006 | Kjorling et al. | 381/98 |
| 2007/0055510 | A1 * | 3/2007 | Hilpert et al. | 704/230 |

FOREIGN PATENT DOCUMENTS

| | | | |
|---|---|---|---|
| RU | 2197776 | C2 | 1/2003 |
| WO | WO2005031704 | A1 | 4/2005 |
| WO | WO-2005036925 | | 4/2005 |
| WO | WO-2005043511 | | 5/2005 |

OTHER PUBLICATIONS

J. Herre et al, "The Reference Model Architecture for MPEG Spatial Audio Coding", Audio Engineering Society Convention paper, NY, May 28, 2005, pp. 1-13, XP009059973.

J. Breebaart et al., "MPEG Spatial Audio Coding/MPEG Surround: Overview and Current Status", Audio Engineering Society Convention paper, NY, Oct. 7, 2005, pp. 1-15, XP002364486.

J. Breebaart et al., "Parametric Coding of Steroe Audio", Eurasip J. Applied Signal Proc.

* cited by examiner

GENERATION OF MULTI-CHANNEL AUDIO SIGNALS

BACKGROUND OF THE INVENTION

1. Technical Field

The invention relates to generation of multi channel audio signals by spatial audio decoding and in particular, but not exclusively, to generation of multi channel audio signals from a matrix encoded surround sound stereo signal.

2. Description of Related Art

Digital encoding of various source signals has become increasingly important over the last decades as digital signal representation and communication increasingly has replaced analogue representation and communication. For example, mobile telephone systems, such as the Global System for Mobile communication, are based on digital speech encoding. Also distribution of media content, such as video and music, is increasingly based on digital content encoding.

Furthermore, in the last decade there has been a trend towards multi channel audio and specifically towards spatial audio extending beyond conventional stereo signals. For example, traditional stereo recordings only comprise two channels whereas modern advanced audio systems typically use five or six channels, as in the popular 5.1 surround sound systems. This provides a more involved listening experience where the user may be surrounded by sound sources.

Various techniques and standards have been developed for communication of such multi channel signals. For example, six discrete channels representing a 5.1 surround system may be transmitted in accordance with standards such as the Advanced Audio Coding (AAC) or Dolby Digital standards.

However, in order to provide backwards compatibility, it is known to down-mix the higher number of channels to a lower number and specifically it is frequently used to down-mix a 5.1 surround sound signal to a stereo signal allowing a stereo signal to be reproduced by legacy (stereo) decoders and a 5.1 signal by surround sound decoders.

Such existing methods for backwards-compatible multi-channel transmission without additional multi-channel information can typically be characterized as matrixed-surround methods. Examples of matrix surround sound encoding include methods such as Dolby Prologic II and Logic-7. The common principle of these methods is that they matrix" multiply the multiple channels of the input signal by a suitable non-quadratic matrix thereby generating an output signal with a lower number of channels. Specifically, a matrix encoder typically applies phase shifts to the surround channels prior to mixing them with the front and center channels. The generation of the down-mixed signal (Lt, Rt) may e.g. be given by:

$$\begin{bmatrix} Lt \\ Rt \end{bmatrix} = \begin{bmatrix} 1 & 0 & q & a\cdot j & b\cdot j \\ 0 & 1 & q & -b\cdot j & -a\cdot j \end{bmatrix} \begin{bmatrix} Lf \\ Rf \\ C \\ Ls \\ Rs \end{bmatrix} \quad (1)$$

Thus, the left down-mix signal (Lt) consists of the left-front signal (Lf), the center signal (c) multiplied by a factor q, the left-surround signal (Ls) phase rotated by 90 degrees ('j') and scaled by a factor a, and finally the right-surround (Rs) signal which is also phase rotated by 90 degrees and scaled by a factor b. The right down-mix signal (Rt) is generated similarly. Typical down-mix factors are 0.707 for q and a, and 0.408 for b.

The rationale for the opposite signs for the right-down-mix signal (Rt) is that the surround channels are mixed in anti-phase in the down-mix pair (Lt, Rt). This property helps the decoder to discriminate between front and rear channels from the down-mix signal pair. A decoder can (partially) reconstruct the multi-channel signal from the stereo down-mix by applying a de-matrixing operation. How accurately the re-created multi-channel signal resemble the original multi-channel signal will depend on the specific properties of the multi-channel audio content.

Although matrixed surround sound systems provide for backwards compatibility, it can only provide low audio quality compared to discrete surround systems/coders, such as AAC or Dolby Digital systems.

A coding/decoding technique known as Spatial Audio Coding (SAC) has been developed to provide improved quality for down-mixed audio signals. In SAC, the decoder down-mixes channels to a lower number and in addition generates parametric data which describes characteristics of the multi-channel signals relative to the down-mixed signals. The additional parametric data is then included in the bit stream together wither the down-mix signal which typically is a mono or stereo audio signal. Thus, legacy decoders can ignore the additional parametric data and re-generate a mono or stereo signal (or possibly a matrix decoded surround sound signal of low quality). Furthermore, SAC decoders can extract the parametric data and use this to generate a multi-channel signal of higher quality.

However, a problem with this approach is that many systems are not equipped for SAC encoded signals. For example, many systems only utilize matrix surround sound encoding that does not generate SAC parametric data. Furthermore, many signal and decoder standards do not provide the flexibility to allow additional parametric data to be included thus requiring a complete switch to a new standard before SAC can be deployed. This may require that all existing encoders and decoders in the system are replaced by SAC enabled encoders and decoders. Specifically, there are many two-channel stereo-based legacy systems (such as radio, digital radio, etc.) where the effort to add the additional information necessary for SAC is unfeasibly large, i.e. the cost to extend such systems to use SAC is too high. Furthermore, there are already large amounts of matrix-encoded audio material available and this would need re-encoding by a SAC encoder before the benefits of SAC decoding can be achieved.

Hence, an improved system for processing and/or communicating multi channel audio signals would be advantageous and in particular functionality allowing increased flexibility, increased audio quality, increased applicability of SAC principles and/or improved performance would be advantageous.

BRIEF SUMMARY OF THE INVENTION

Accordingly, the Invention seeks to preferably mitigate, alleviate or eliminate one or more of the above mentioned disadvantages singly or in any combination.

According to a first aspect of the invention there is provided a decoder for generating a multi channel audio signal, the decoder comprising: means for receiving a first signal comprising a first set of audio channels; estimating means for generating estimated parametric data for a second set of audio channels in response to characteristics of the first set of audio channels; the estimated parametric data relating characteristics of the second set of audio channels to characteristics of the first set of audio channels; and a spatial audio decoder for decoding the first signal in response to the estimated parametric data to generate the multi-channel audio signal comprising the second set of channels.

The invention may allow improved performance. Specifically, the invention may allow spatial audio decoding principles to be used for signals not comprising Spatial Audio Coding (SAC) parameters. The applicability of the decoder may be substantially increased and it may for example be used with matrix encoders and encoded signals. An improved audio quality can be achieved by the spatial audio decoding.

The second set of channels generally comprises more channels than the first set of channels. The second set of audio channels may comprise one or more of the first set of audio channels. One or more of the second set of audio channels may be generated without using the estimated parametric data. The estimated parametric data may specifically be data corresponding to spatial audio parameters and in particular to spatial audio parameters as are typically generated by conventional SAC encoders.

The estimated parametric data may directly relate a specific characteristic of the first set channels to a specific characteristic of the second set of channel and/or may e.g. comprise data values relating characteristics of different channels of the second set of channels thereby being indicative of how the first signal can be decoded to provide the second set of audio channels. The characteristics may be a series of measures of one single parameter over different time intervals. Alternatively, the characteristics may pertain to more than one single parameter.

According to an optional feature of the invention, the first signal comprises no parametric audio data related to the second set of channels.

The invention allows spatial audio decoding principles to be applied to a signal comprising no parametric audio data for at least some of the output channels. Thus, the invention may allow improved quality for non-SAC encoded signals. The invention may allow improved backwards compatibility and may in particular allow improved audio quality for decoded surround sound signals from matrix encoded surround sound signals.

According to an optional feature of the invention, the estimating means comprises means for determining first parameter data for the first set of audio channels and means for mapping the first parameter data to the estimated parameter data for the second set of audio channels.

This may allow an efficient implementation and an estimation of parameter data which may provide particularly high decoded audio quality. The mapping may e.g. be by use of a look-up table or by an evaluation of a mathematic function. Thus, a direct relationship exists between estimated parameter values and specific parameter values of the first parameter data.

According to an optional feature of the invention, the first parameter data comprises at least one inter-channel level difference value for at least two audio channels of the first set of audio signals.

This may allow an efficient implementation and an estimation of parameter data which may provide particularly high decoded audio quality. In particular, research has shown that an inter-channel level difference value is particularly suited for estimating associated SAC parametric data from a matrix encoded surround sound signal. The inventors of the current invention have realized that there is a high correlation between the inter-channel level difference for e.g. a stereo matrix encoded surround sound signal and SAC data for the surround sound signal.

According to an optional feature of the invention, the first parameter data comprises at least one inter-channel correlation coefficient value for at least two audio channels of the first set of audio signals.

This may allow an efficient implementation and an estimation of parameter data which may provide particularly high decoded audio quality. In particular, research has shown that an inter-channel correlation coefficient value is particularly suited for estimating associated SAC parametric data from a matrix encoded surround sound signal. The inventors of the current invention have realized that there is a high correlation between the inter-channel correlation coefficient for e.g. a stereo matrix encoded surround sound signal and SAC data for the surround sound signal.

According to an optional feature of the invention, the multi channel audio signal is a surround sound signal and the estimated parameter data comprises at least one parameter selected from the group consisting of: an inter-channel level difference between a left-front and a left-surround channel of the second set of channels; an inter-channel level difference between a right-front and a right-surround channel of the second set of channels; an inter-channel correlation coefficient between a left-front and a left-surround channel of the second set of channels; an inter-channel correlation coefficient between a right-front and a right-surround channel of the second set of channels; a prediction coefficient for a center channel of the second set of audio channels; and an inter-channel level difference between a center channel and another channel (or combination of channels) of the second set of channels.

This may allow particularly high performance. Specifically, these parameters are particularly suitable for generating a high quality decoded signal by a spatial audio decoder and typically have a high correlation between parameters of an input signal such as a matrix encoded surround sound system.

The at least one parameter selected from the group may be generated by a direct mapping from the inter-channel level difference value and/or the inter-channel correlation coefficient value for at least two audio channels of the first set of audio signals to the at least one parameter.

According to an optional feature of the invention, the apparatus further comprises means for generating time frequency tiles; and wherein the estimating means is arranged to generate the estimated parametric data for time frequency tiles.

This facilitates operation and/or improves quality. In particular, it may allow a facilitated and/or improved mapping between parameters extracted from the first signal and the estimated parametric data.

According to an optional feature of the invention, the estimating means comprises means for directly mapping a set of at least one signal characteristic of the first set of audio channels for a time frequency tile to a value of parametric data for the second set of audio channels.

This may allow an efficient implementation and an estimation of parameter data which may provide particularly high decoded audio quality. The mapping may e.g. be by use of a look-up table or by an evaluation of a mathematic function. Thus, a direct relation is applied between the set of signal characteristics and corresponding values of the estimated parameter data. The signal characteristics may be an inter-channel level difference and/or an inter-channel correlation coefficient for two channels of the first set of audio channels and these may directly map to e.g. prediction coefficients and/or inter-channel correlation coefficients and/or inter-channel level differences for the second set of audio channels.

According to an optional feature of the invention, the spatial audio decoder is arranged to perform at least one matrix operation using parameters determined in response to the estimated parametric data.

This may allow high performance. In particular it may allow a suitable implementation with high decoding quality.

According to an optional feature of the invention, the decoder further comprises means for extracting parametric data for a second signal, and the spatial audio decoder is operable to decode the second signal in response to the extracted parametric data.

The decoder may be arranged to handle both SAC encoded signals and non-SAC encoded signals using the same spatial audio encoder. For SAC encoded signals, extracted data may be used whereas for non-SAC encoded signals, estimated parametric data may be used. The invention may provide increased applicability and/or backwards compatibility. The apparatus may be arranged to decode the first signal in response to the extracted parametric data thereby allowing correlations between the first and second signal to be exploited.

According to an optional feature of the invention, the decoder further comprises means for selecting a decoding mode in response to a characteristic of the first signal.

The decoder may for example be arranged to operate in a first mode wherein SAC parametric data is estimated and in a second mode wherein SAC parametric data is extracted from the received signal and may be arranged to select between the first and second mode in response to whether the first signal comprises SAC data or not. Thus, a highly flexible decoder capable of processing a variety of different types of signal can be achieved.

According to an optional feature of the invention, the first set of audio channels consists of two audio channels.

The invention may allow improved decoding of multi-channel signals down-mixed to a stereo signal.

According to an optional feature of the invention, the first signal is a matrix encoded surround sound signal.

The invention may allow particularly improved decoding of multi-channel signals down-mixed to a matrix encoded surround sound signal. In particular, experiments have shown that very accurate SAC data can be estimated for matrix encoded surround sound signals based on the stereo channels of the signal.

According to an optional feature of the invention, the decoder further comprises a matrix-surround inversion matrix, and means for determining at least one coefficient of the matrix-surround inversion matrix in response to the estimated parametric data.

This may allow improved decoded audio quality for a matrix encoded surround signal.

According to another aspect of the invention, there is provided a method of generating a multi channel audio signal, the method comprising: receiving a first signal comprising a first set of audio channels; generating estimated parametric data for a second set of audio channels in response to characteristics of the first set of audio channels; the estimated parametric data relating characteristics of the second set of audio channels to characteristics of the first set of audio channels; and a spatial audio decoder decoding the first signal in response to the estimated parametric data to generate the multi-channel audio signal comprising the second set of channels.

According to another aspect of the invention, there is provided a computer program product for executing the method.

According to another aspect of the invention, there is provided a receiver for generating a multi channel audio signal, the receiver comprising: means for receiving a first signal comprising a first set of audio channels; estimating means for generating estimated parametric data for a second set of audio channels in response to characteristics of the first set of audio channels; the estimated parametric data relating characteristics of the second set of audio channels to characteristics of the first set of audio channels; and a spatial audio decoder for decoding the first signal in response to the estimated parametric data to generate the multi-channel audio signal comprising the second set of channels.

According to another aspect of the invention, there is provided a transmission system including: an encoder for generating a first signal comprising a first set of audio channels by encoding a multi channel signal; a transmitter for transmitting the first signal; means for receiving the first signal; estimating means for generating estimated parametric data for a second set of audio channels in response to characteristics of the first set of audio channels; the estimated parametric data relating characteristics of the second set of audio channels to characteristics of the first set of audio channels; and a spatial audio decoder for decoding the first signal in response to the estimated parametric data to generate a decoded multi-channel audio signal comprising the second set of channels.

According to another aspect of the invention, there is provided a method of transmitting and receiving an audio signal, the method comprising: generating a first signal comprising a first set of audio channels by encoding a multi channel signal; transmitting the first signal; receiving the first signal; generating estimated parametric data for a second set of audio channels in response to characteristics of the first set of audio channels; the estimated parametric data relating characteristics of the second set of audio channels to characteristics of the first set of audio channels; and a spatial audio decoder decoding the first signal in response to the estimated parametric data to generate a decoded multi-channel audio signal comprising the second set of channels.

According to another aspect of the invention, there is provided an audio playing device comprising a decoder as described above.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF THE INVENTION

The following description focuses on embodiments of the invention applicable to decoding of matrixed surround sound signals down-mixed to stereo signals. However, it will be appreciated that the invention is not limited to this application but may be applied to many other signals.

Figure 1:
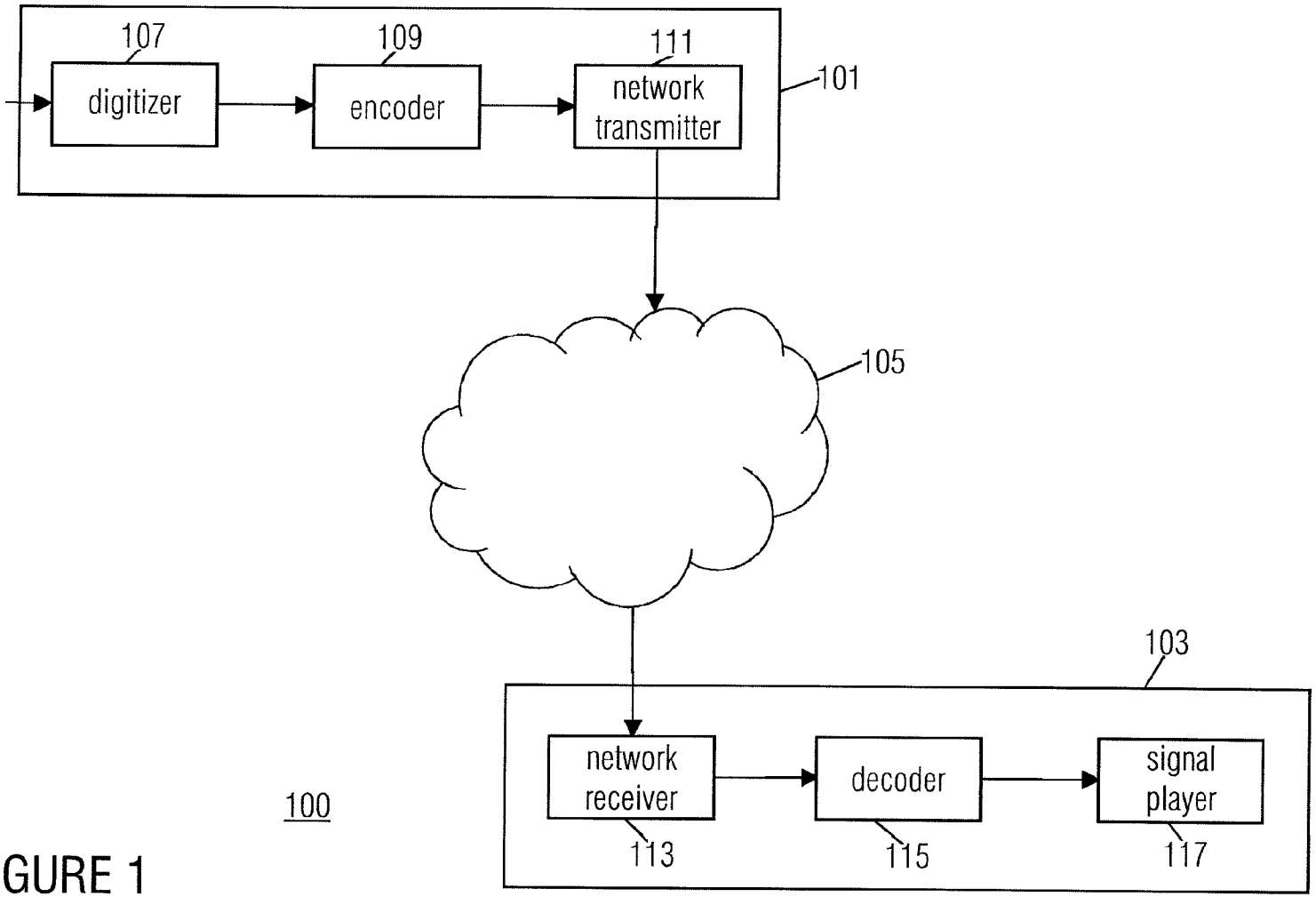
FIG. 1 illustrates a transmission system for communication of an audio signal in accordance with some embodiments of the invention.

FIG. 1 illustrates a transmission system 100 for communication of an audio signal in accordance with some embodiments of the invention. The transmission system 100 comprises a transmitter 101 which is coupled to a receiver 103 through a network 105 which specifically may be the Internet.

In the specific example, the transmitter 101 is a signal recording device and the receiver is a signal player device 103 but it will be appreciated that in other embodiments a transmitter and receiver may used in other applications and for other purposes. For example, the transmitter 101 and/or the receiver 103 may be part of a transcoding functionality and may e.g. provide interfacing to other signal sources or destinations.

In the specific example where a signal recording function is supported, the transmitter 101 comprises a digitizer 107 which receives an analog signal that is converted to a digital PCM signal by sampling and analog-to-digital conversion. The analog signal is specifically a 5.1 surround sound multi-channel signal.

The transmitter 101 is coupled to the encoder 109 of FIG. 1 which encodes the PCM signal in accordance with an encoding algorithm. Specifically, the encoder is a matrix encoder that generates a down-mixed stereo signal using the matrix operation of equation 1. Thus, the encoded signal is a matrix encoded surround sound signal.

The encoder 100 is coupled to a network transmitter 111 which receives the encoded signal and interfaces to the Internet 105. The network transmitter may transmit the encoded signal to the receiver 103 through the Internet 105.

The receiver 103 comprises a network receiver 113 which interfaces to the Internet 105 and which is arranged to receive the encoded signal from the transmitter 101.

The network receiver 111 is coupled to a decoder 115. The decoder 115 receives the encoded signal and decodes it in accordance with a decoding algorithm.

In the specific example where a signal playing function is supported, the receiver 103 further comprises a signal player 117 which receives the decoded audio signal from the decoder 115 and presents this to the user. Specifically, the signal player 113 may comprise a digital-to-analog converter, amplifiers and speakers as required for outputting the decoded audio signal.

In the described embodiment the decoding algorithm used by the decoder 115 comprises a SAC decoding element. For clarity, the operation of a typical SAC encoder will first be described.

Figure 2:
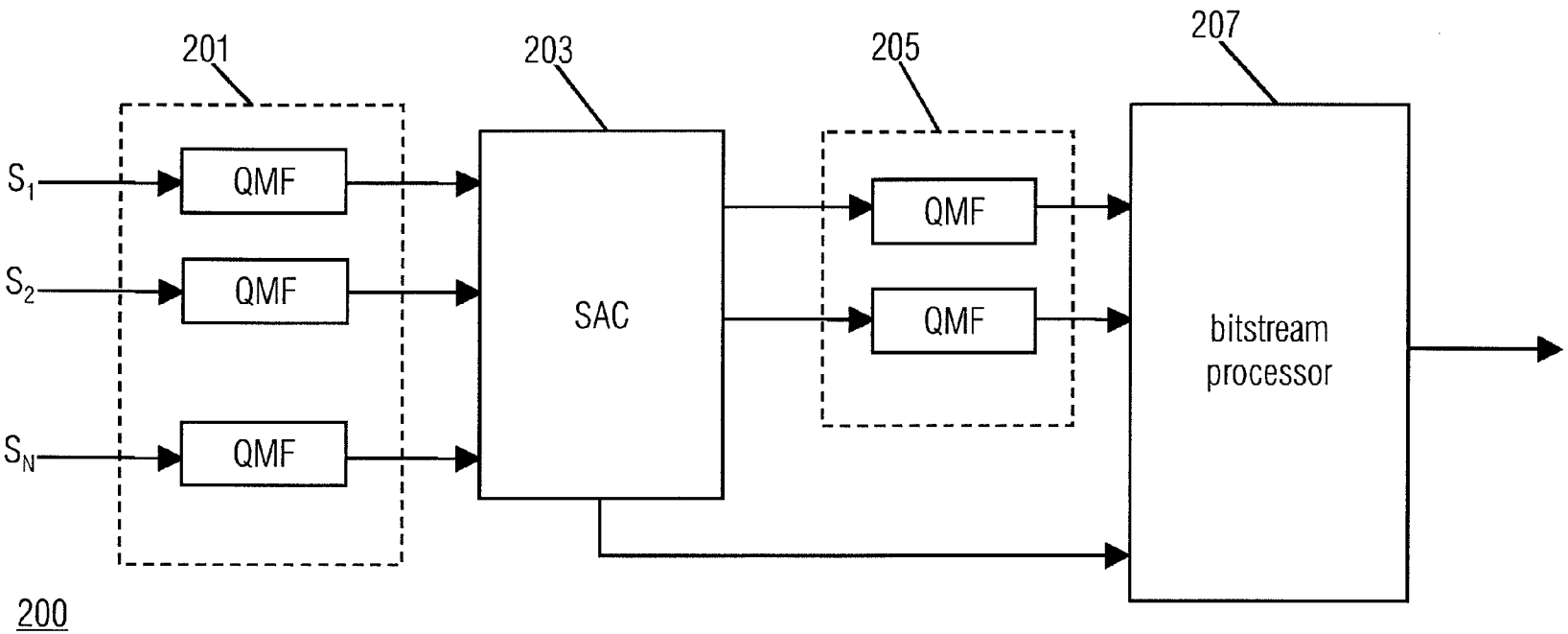
FIGURE 2 (PRIOR ART)
FIG. 2 illustrates a block diagram of a typical SAC encoder.

FIG. 2 illustrates a block diagram of a typical SAC encoder 200. The encoder 200 splits the incoming signals in separate time-frequency tiles by means of a Quadrature Mirror Filter (QMF) bank 201. These time/frequency tiles are generally referred to as "parameter bands".

For every parameter band, a SAC encoding element 203 determines a number of spatial parameters that describe the properties of the spatial image, e.g. inter-channel level differences and cross correlation coefficients. Besides the extraction of parameters, the SAC encoding element 203 also generates a mono or stereo down-mix from the multi-channel input signal. By means of QMF synthesis banks 205 these signals are transferred to the time-domain. The resulting down-mix is fed to a bit-stream processor 207 which generates a bit-stream comprising the down-mix channels and the parametric data generated by the SAC encoding element 203. Preferably, the down-mix is also encoded before transmission (using conventional mono or stereo 'core' coder), while the bit-streams of the core coder and the spatial parameters are preferably combined (multiplexed) into a single output bit-stream.

Depending on the mode of operation, this data rate of the parametric data can cover a wide range of bit rates, starting from a few kBit/s for good quality multi-channel audio up to tens of kBit/s for near-transparent quality.

Moreover, in case of a stereo down-mix, the user has the choice of a conventional stereo down-mix or a down-mix that is compatible with matrixed-surround systems. In the latter case, the encoder 200 can generate a matrixed-surround compatible down-mix using the matrixing approach of Equation 1. Alternatively, it may generate a matrixed-surround compatible down-mix using a down-mix post processing unit working on a regular stereo down-mix. In this configuration, the encoder can comprise a matrixed-surround post processor which modifies the regular stereo down-mix to make it matrixed-surround sound compatible using the spatial parameters extracted by the parameter-estimation stage. The advantage of such an approach is that the matrixed-surround processing can be fully reversed by a decoder having the spatial parameters available.

Figure 3:
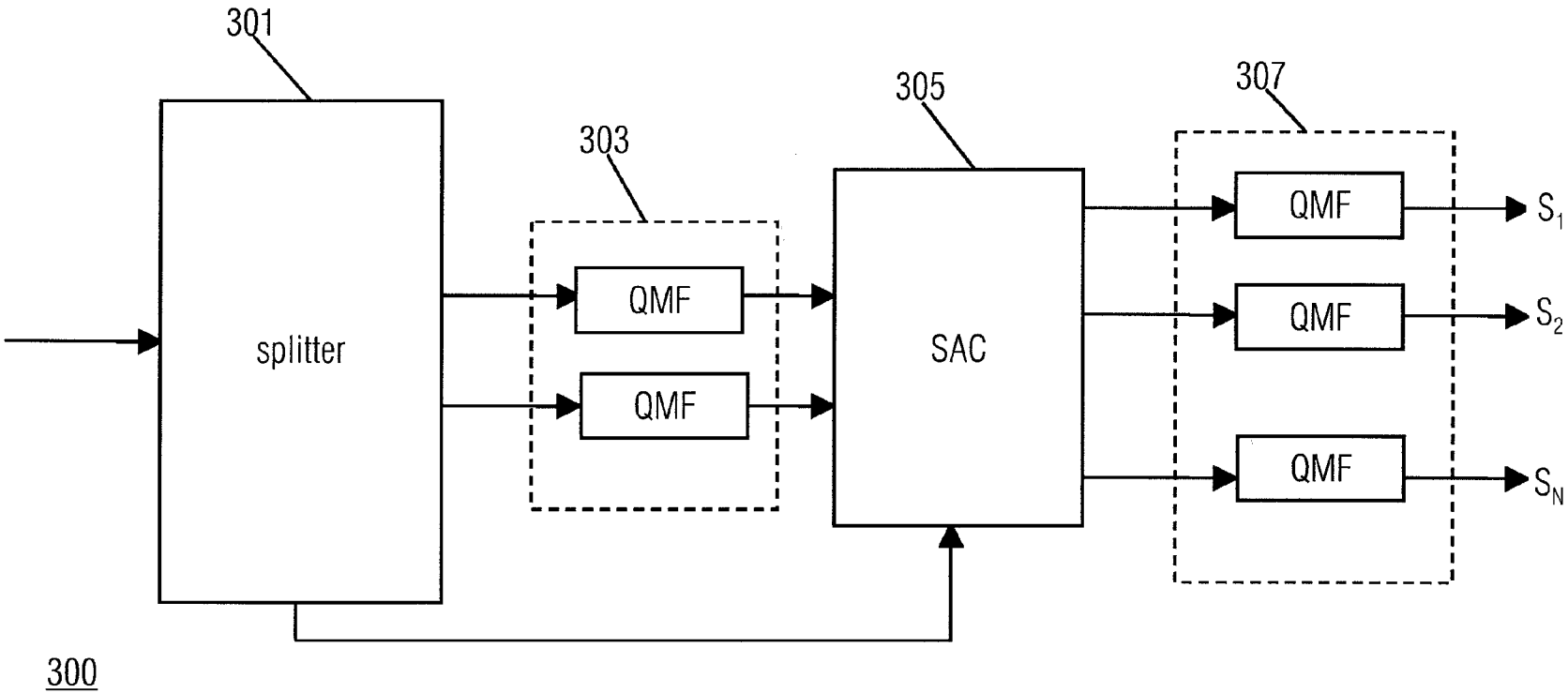
FIGURE 3 (PRIOR ART)
FIG. 3 illustrates an example of a typical SAC decoder.

A SAC decoder in principle performs the reverse process of the encoder. FIG. 3 illustrates an example of a typical SAC decoder. The SAC decoder 300 comprises a splitter 301 which receives the bit-stream and splits it into the down-mix signal and the parametric data. Subsequently, the decoded down-mix is processed by a QMF analysis bank 303 to result in parameter bands that are the same as those applied in the SAC encoder 200. A spatial synthesis stage 305 reconstructs the multi-channel signal using the parametric data extracted by the splitter 301. Finally, the QMF-domain signals are transferred to the time domain by means of a QMF synthesis bank 307 to result in the final multi-channel output signals.

Thus in systems where both encoders and decoders comprise SAC functionality, a high quality of the decoded multi-channel signals can be achieved for a relatively low data rate. However, as many already deployed systems and much audio material do not exploit SAC functionality, the benefits are typically restricted to new systems and re-encoded audio material.

In the example of FIG. 1, the decoder 115 comprises SAC decoding functionality which may be used with non-SAC encoders and non-SAC encoded material. The decoder 115 may thus introduce some of the advantages of SAC without requiring re-encoding or SAC compatible encoders and may specifically provide a significantly improved quality to data rate ratio for multi-channel signals.

Figure 4:
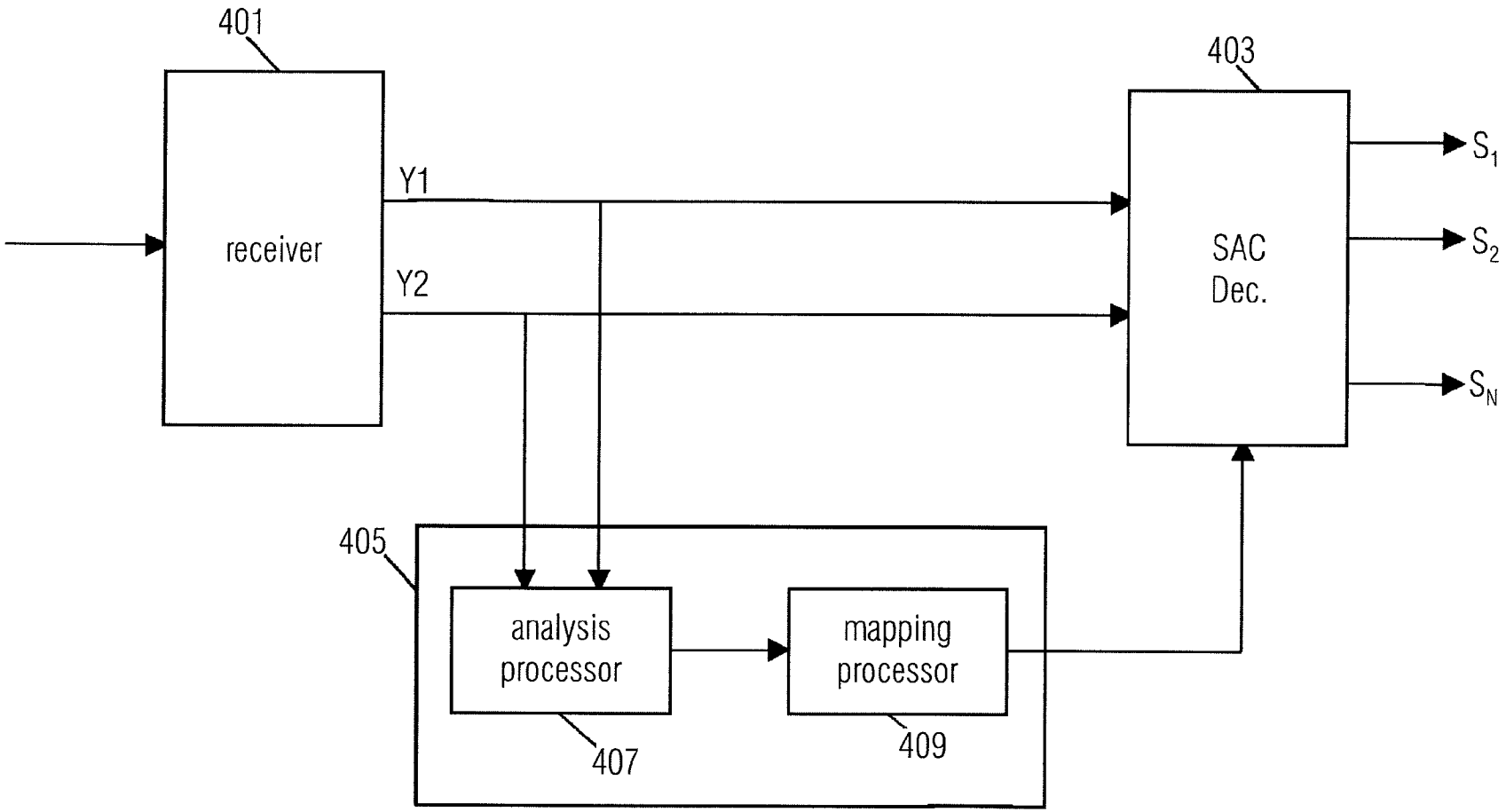
FIG. 4 illustrates a decoder in accordance with some embodiments of the invention.

FIG. 4 illustrates the decoder 115 of FIG. 1 in more detail. The decoder 115 comprises a receiver 401 which receives a signal comprising a set of audio channels. Specifically, the receiver receives the bit-stream comprising the two channels which have been generated by the matrix encoding of the surround sound signal by the encoder 109. The receiver 401 receives the bit-stream and generates the two channels $y_1$, $y_2$ of the down-mix stereo signal. It will be noted that in the specific example, the encoder 109 is a conventional matrix encoder for a surround signal generating a bit-stream comprising only the two down-mix channels. Thus, in the example, the bit-stream comprises no spatial audio parametric data. In other embodiments, the encoder 109 may for example be a SAC encoder generating a matrix-surround compatible stereo signal without SAC parametric data.

The decoder 115 further comprises a SAC decoding element 403 coupled to the receiver 401. The SAC decoding element 403 decodes the stereo down-mix channels $y_1$, $y_2$ using SAC techniques as previously described. Specifically, the operation of the SAC decoding element 403 corresponds to that described for the SAC decoder 300 of FIG. 3. The SAC decoding element 403 thus generates an output surround sound signal corresponding to the surround signal which was matrix encoded by the encoder 109.

As previously described, the stereo down-mix channels may have been encoded by a matrix encoder as described in Eq. 1. Alternatively, the down-mix channels may have been generated by an SAC encoder 203 including a post-processing unit to generate a matrix-surround compatible down mix. In both cases, the SAC decoding element 403 may include a pre-processing unit that inverts the operations applied by the encoder for matrix-surround compatibility.

The decoder 115 further comprises an estimate processor 405 which is coupled to the receiver 401 and the SAC decoding element 403. The estimate processor 405 is arranged to generate estimated parametric data which can be used to generate the output surround signals. Specifically, the estimate processor 405 estimates the parametric data that a SAC encoder would have generated for the down-mix channels if SAC encoding had been performed. Thus, the estimated parametric data relates characteristics of the output surround channels to characteristics of the received down-mix channels as it provides information of how these can be decoded to generate the output surround channels.

In the example of FIG. 4, the estimate processor 405 generates the estimated parametric data such that it corresponds to SAC data that the SAC decoding element 403 can directly use to determine the output surround channels.

Thus, the decoder 115 uses the principles of SAC for decoding matrix-encoded surround audio material. The estimate processor 405 uses signal cues of the received stereo input signal to determine data which is used by the SAC decoding element 403. Specifically, the estimate processor 405 estimates inter-channel cues of the received stereo signal and maps this to SAC cues that can be used directly by the SAC decoding element 403. This may specifically allow the SAC decoding element 403 to be a conventional SAC decoder thereby facilitating backwards compatibility, reducing design and development requirements and allowing the same functionality to be used for decoding SAC encoded signals and non-SAC encoded signals. Thus, in the example, the required SAC parameters are generated at the decoder side using parameters obtained by analysis of the received two-channel down-mix.

The estimate processor 405 comprises an analysis processor 407 which determines one or more parameters for the stereo down-mix signal. Specifically, the analysis processor 407 generates Inter-channel Level Difference (ILD) values and Inter-channel Correlation Coefficient (ICC) values for the stereo down-mix channels $y_1$, $y_2$.

The analysis processor 407 is coupled to a mapping processor 409 which maps the ILD and ICC values into SAC values relating to the output channels.

The mapping processor 409 specifically utilizes the previously unknown and surprising fact that a close correlation typically exists between ILD and ICC values for a matrix encoded surround signal and spatial audio parameters for the original surround sound channels.

The mapping processor 409 can simply use a look-up table to determine SAC parameter values for the output surround channels relative to the stereo down-mix channels $y_1$, $y_2$. The determined ILD and ICC values or representatives thereof, for example after quantization, can be used as the address for the table look-up. Equivalently, the mapping processor 409 can evaluate a predetermined function having the ICC and ILD values as input parameters and providing the required SAC parameters as output parameters.

In this way, the mapping processor 409 can generate (e.g.) the following SAC parameters for the output surround sound channels:

- An inter-channel level difference between a left-front and a left-surround channel.
- An inter-channel level difference between a right-front and a right-surround channel.
- An inter-channel correlation coefficient between a left-front and a left-surround channel.
- An inter-channel correlation coefficient between a right-front and a right-surround channel.
- One or more prediction coefficient(s) for a channel such as the center channel.
- An inter-channel level difference between a center channel and another channel (or combination of channels) of output surround sound channels.

As a specific example, the analysis processor 407 can generate an ICC value and an ILD value for the stereo down-mix channels $y_1$, $y_2$. These two values are then used to generate a unique address for a look-up table. At the specific address, the SAC parametric values which typically occur for these ICC and ILD values have been stored. The mapping processor 409 thus simply retrieves the stored data values thereby obtaining suitable estimated parametric data. This data is then fed to the SAC decoding element 403 where it is used in the same way as conventional SAC data generated by a SAC encoder.

It will be appreciated that the corresponding SAC parameter values for given ILD and ICC values can be determined in any suitable way. For example, simulations may be performed wherein a large number of signals are encoded both by matrix encoding and SAC encoding. The ICC and ILD values may then be derived for the matrix encoded signals and compared to the parametric data generated by the SAC encoder. The data may be statistically processed to determine the SAC parameters which are most likely to occur for given ILD and ICC values, and can then be stored in the appropriate location of the look-up table. It will be appreciated that such analysis is only needed once and that the determined look-up table can be used by many decoders and for any received signal.

Indeed, experiments and simulations have demonstrated that a close correlation exists between the ICC and ILD values of a matrix encoded down-mixed surround sound signal and the SAC values for a SAC encoded surround sound signal. Accordingly, the SAC parameters may be estimated with a relatively high accuracy and a significantly improved decoded audio quality can be achieved.

In the example of FIG. 4, the estimate processor 405 operates on the basis of time-frequency tiles.

Specifically, the stereo down-mix channels $y_1$, $y_2$ are first processed by a complex-modulated QMF filter bank to generate individual time-frequency tiles. It will be appreciated that such processing may be shared between the estimate processor 405 and the SAC decoding element 403 and may for example be implemented in the SAC decoding element 403. Generation of time-frequency tiles encompassing a frequency band for a time interval are well known to the person skilled in the art and will not be described in detail (an example can e.g. be found in Breebaart, J., van de Par, S., Kohlrausch, A., and Schuijers, E. (2005). Parametric coding of stereo audio. Eurasip J. Applied Signal Proc., 9: 1305-1322).

Time-frequency tiles are formulated by grouping certain frequency bands and time segments. Typically, these time-frequency tiles are relatively narrow at low frequencies and wider at high frequencies, according to psychoacoustic principles. The corresponding time resolution is typically between 11 and 50 ms.

For each generated time-frequency tile, the analysis processor 407 generates the two parameters ILD and ICC from the stereo down-mix channels $y_1$, $y_2$. Specifically, if $Y_1$ [k,b] represents the (complex-valued) filter-bank output for signal $y_1$ for filter output q and time sample k, and $Y_2$[k,b] represents the corresponding QMF-domain representation for $y_2$, the ILD parameter for parameter band b is given by:

$$ILD[b] = 10\log_{10}\frac{\sum_k\sum_q Y_1[k,q]Y_1^*[k,q]}{\sum_k\sum_q Y_2[k,q]Y_2^*[k,q]},$$

where the summation range for k is performed over the corresponding QMF-domain time samples of the current time/frequency tile, summation over q is performed over those filter-bank outputs that correspond to parameter band b, and (*) denotes complex conjugation.

Similarly, with $\Re$ denoting the real part, the ICC value for parameter band b is given by:

$$ICC[b] = \frac{\Re\left(\sum_k\sum_q Y_1[k,q]Y_2^*[k,q]\right)}{\sqrt{\sum_k\sum_q Y_1[k,q]Y_1^*[k,q]\sum_k\sum_q Y_2[k,q]Y_2^*[k,q]}}$$

For each pair of ICC and ILD values, the mapping processor 409 may then perform a table look up and determine:

- ILDs between corresponding time-frequency tiles of the left front and left surround channels;
- ILDs between corresponding time-frequency tiles of the right front and right surround channels;
- ICCs between the corresponding time-frequency tiles of left front and left surround channels;
- ICCs between the corresponding time-frequency tiles of right front and right surround channels;
- prediction coefficients to generate the center channel from the down-mix, and/or
- ILDs between the center channel and any other channel (pair).

The decoder is thus fed estimated parametric data which corresponds to the SAC parametric data that would have been produced by a SAC encoder.

Figure 5:
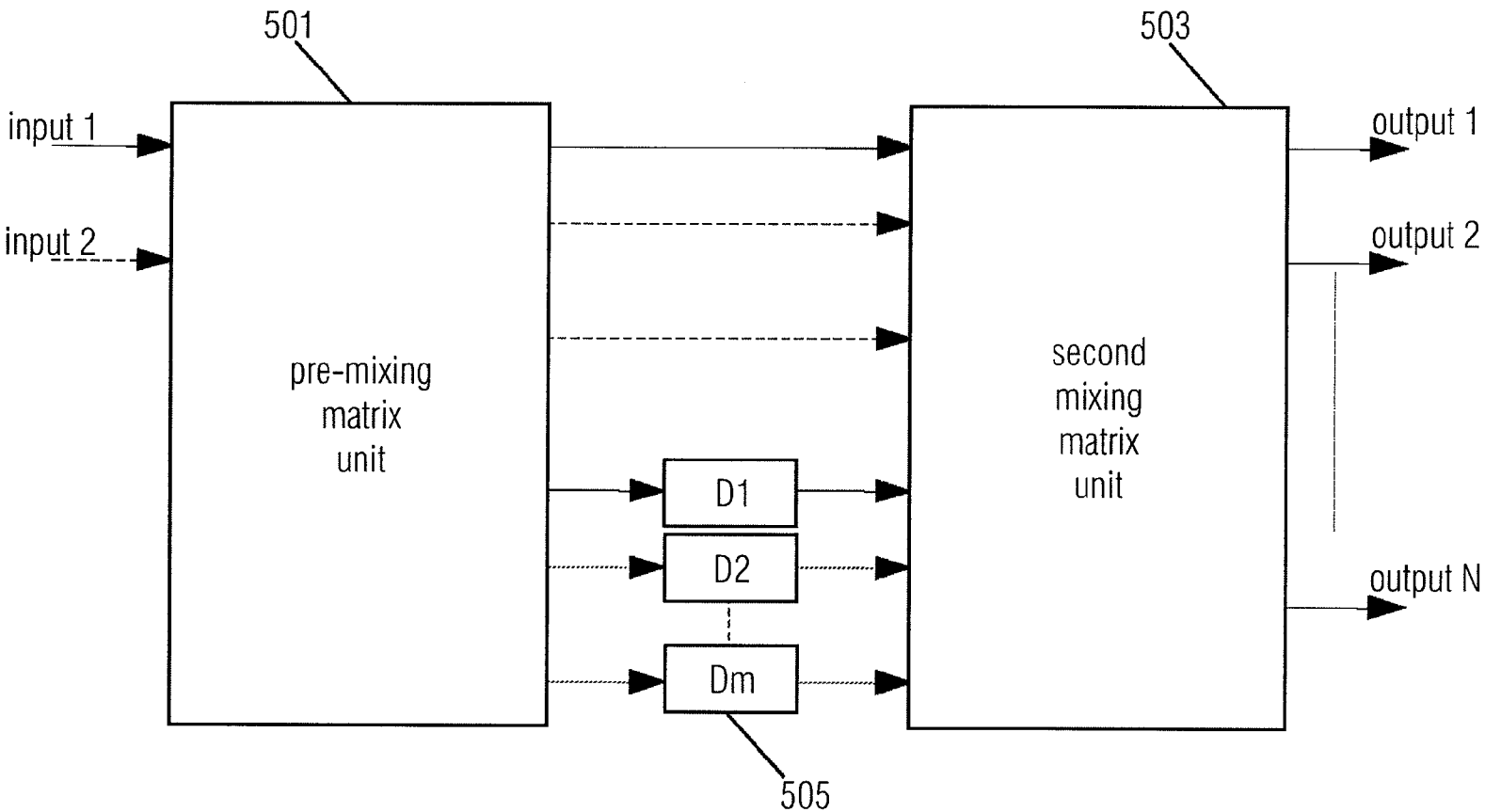
FIG. 5 illustrates elements of a decoder in accordance with some embodiments of the invention.

FIG. 5 illustrates elements of the SAC decoding element 403 in more detail.

The SAC decoding element 403 comprises a pre-mixing matrix unit 501 which controls the signals that enter a second mixing matrix unit 503 as well as the inputs for a set of decorrelators (D1 to Dm) 505. The second mixing matrix generates the output signals based on the decorrelator outputs and the direct outputs of the pre-mixing matrix 501. The operation of a SAC is well known to the person skilled in the art and will for clarity and brevity not be described further herein. Further details may e.g. be found in Herre et al.: "The reference model architecture for MPEG spatial audio coding". Proc. 118$^{th}$ AES convention, Barcelona, Spain, 2005.

The estimated parametric data received from the estimate processor 405 is used to control the pre-mixing matrix unit 501 and the second mixing matrix unit 503 as if it was conventional SAC parametric data. Specifically, the pre-mixing matrix unit 501 may use a pre-mix matrix M1 to generate three intermediate signals l, r and c from the input signals $y_1$, $y_2$ as:

$$\begin{bmatrix} l \\ r \\ c \end{bmatrix} = M_1\begin{bmatrix} y_1 \\ y_2 \end{bmatrix},$$

with $$M_1 = \begin{bmatrix} c_1+2 & c_2-1 \\ c_1-1 & c_2+1 \\ 1-c_1 & 1-c_2 \end{bmatrix},$$

where $c_1$ and $c_2$ represent two of the spatial parameters (prediction coefficients) generated by the mapping processor 409. The two decorrelators $D_1$ and $D_2$ 505 are fed by signals l and r, respectively. Finally, the output signals $l_f$, $r_f$, c, $l_s$ and $r_s$, for the left-front, right-front, center, left-surround and right-surround channels are generated by means of a post-mix matrix $M_2$ in the second mixing matrix unit 503:

$$\begin{bmatrix} l_f \\ r_f \\ c \\ l_s \\ r_s \end{bmatrix} = M_2\begin{bmatrix} l \\ r \\ c \\ D_1 \\ D_2 \end{bmatrix},$$

with $$M_2 = \begin{bmatrix} h_{11,L} & 0 & 0 & h_{12,L} & 0 \\ 0 & h_{11,R} & 0 & 0 & h_{12,R} \\ 0 & 0 & 1 & 0 & 0 \\ h_{21,L} & 0 & 0 & h_{21,L} & 0 \\ 0 & h_{21,R} & 0 & 0 & h_{22,R} \end{bmatrix},$$

with $h_{xy,z}$ depending on the ILD and ICC parameters generated by the mapping processor 409:

$$h_{11,X} = p_{1,X}\cos(v_X + \mu_X)$$
$$h_{12,X} = p_{1,X}\sin(v_X + \mu_X)$$
$$h_{21,X} = p_{2,X}\cos(v_X - \mu_X)$$
$$h_{22,X} = p_{2,X}\sin(v_X - \mu_X)$$

with $$p_{1,X} = \sqrt{\frac{2.10^{ILD_X/10}}{1+10^{ILD_X/10}}}$$
$$p_{2,X} = \sqrt{\frac{2}{1+10^{ILD_X/10}}}$$
$$\mu_X = \frac{1}{2}\arccos(ICC_X)$$
$$v_X = \frac{\mu_X(p_{2,X} - p_{1,X})}{\sqrt{2}}$$

Here, $ILD_X$ and $ICC_X$ represent the ILD and ICC parameter generated by mapping processor 409 for channel pair X (left front/left surround, or right front/right surround).

In case of a SAC encoder working in a matrix-surround compatible mode by means of an encoder post-processor, the corresponding decoder-side pre-processor may be included in pre-mixing matrix unit 501. In this specific case, an alternative pre-mixing matrix may be used, which consists of a combination of the original pre-mixing matrix $M_1$ and a matrix-surround compatible inversion matrix Q:

$$M_1' = M_1 Q = \begin{bmatrix} c_1+2 & c_2-1 \\ c_1-1 & c_2+1 \\ 1-c_1 & 1-c_2 \end{bmatrix} Q,$$

with the matrix-surround inversion matrix Q given by:

$$Q = \begin{bmatrix} q_{11} & q_{12} \\ q_{21} & q_{22} \end{bmatrix},$$

where $q_{xy,z}$ is function of the parameters generated by mapping processor 409:

$$Q = \frac{1}{1 - w_l - w_r + w_l w_r + (w_l - w_r)j - (g_1 g_2 - 1) w_l w_r} \begin{bmatrix} 1 - w_r - w_r j & -w_r j g_2 \\ w_l j g_1 & 1 - w_l + w_l j \end{bmatrix},$$

with $g_1 = g_2 = 0.577$, and $w_l$ and $w_r$ functions of the parameters given by the mapping processor 409:

$$w_X = \begin{cases} \dfrac{1}{1 + 10^{ILD_X/20}} & \text{if} \quad |c_X| > 1 \\ \dfrac{1}{1 + 10^{ILD_X/20}} \dfrac{1 + 2c_X}{3} & \text{if} \quad -0.5 \le c_X \le 1 \\ \dfrac{1}{1 + 10^{ILD_X/20}} \dfrac{-1 - 2c_X}{1} & \text{if} \quad -1 < c_X < -0.5 \end{cases}$$

Alternatively, the entries of M1 or M1' may also be generated directly by mapping processor 409, omitting the equations given above.

It will be appreciated that although the above description focused on an embodiment wherein the received signal comprises no SAC parametric data, some parametric data may be included in the received signal in other embodiments. For example, the received signal may comprise parametric data relating to some output channels but not to other output channels and the estimated parameters may be used for these other channels. As another example, the estimated parametric data may be used to replace parametric data which has been corrupted, for example due to transmission errors. Thus, the estimated parametric data may be used to enhance and complement other parametric data received from the encoder.

Furthermore, it will be appreciated that one of the advantages of the described examples is that the SAC decoding element 403 can use a standard SAC decoding technique. Thus, the SAC decoding element 403 may equally be applied to decoding conventional SAC signals received from a SAC encoder.

Specifically, the transmission system 100 of FIG. 1 may comprise a number of non-SAC encoders and a number of SAC encoders. The decoder 115 may modify its operation according to the signal being received. Thus, if a non-SAC signal is received the operation may be as described above. However, if a SAC signal is received, the parametric data may simply be extracted and fed to the SAC decoding element 403 together with the down-mix channels. Hence, a highly flexibly decoder can be achieved.

Figure 6:
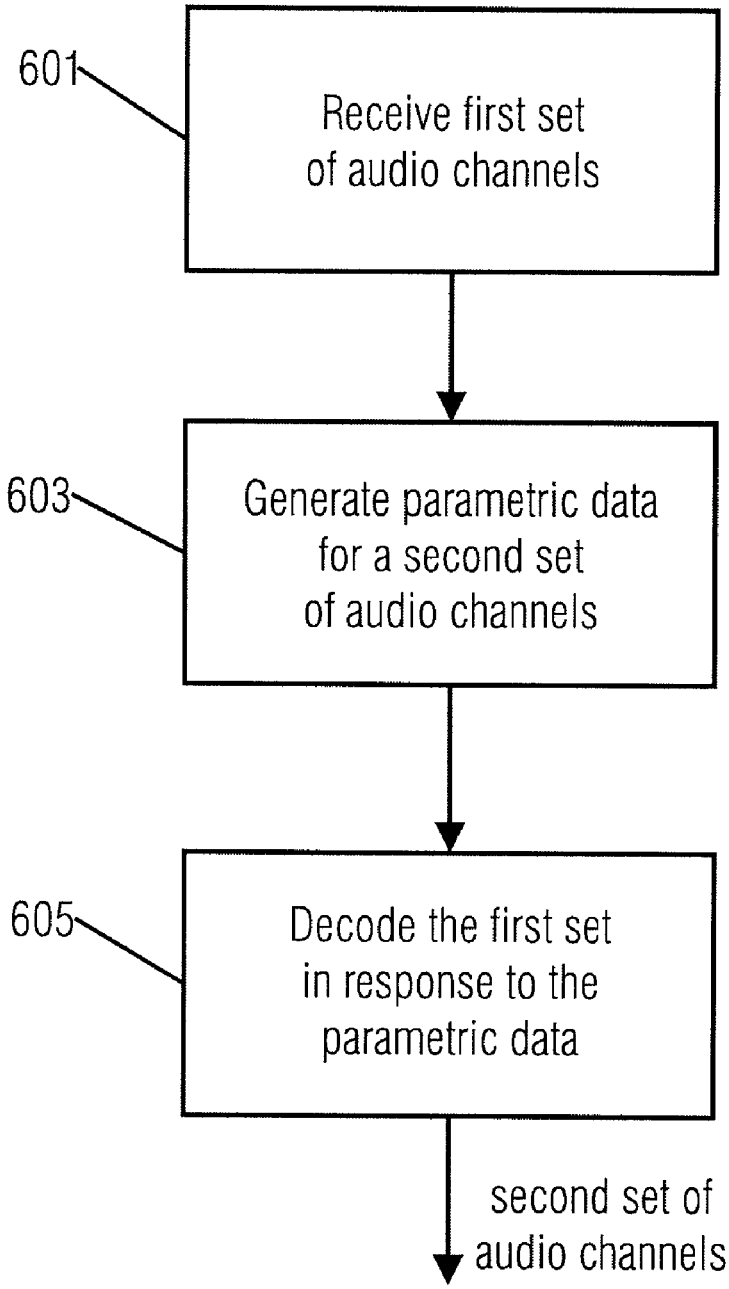
FIG. 6 illustrates a method of generating a multi channel audio signal in accordance with some embodiments of the invention.

FIG. 6 illustrates a method of generating a multi channel audio signal in accordance with some embodiments of the invention. The method is applicable to the decoder 115 of FIG. 4 and will be describe with reference thereto.

The method initiates in step 601 wherein the receiver 401 receives a first signal comprising a first set of audio channels.

Step 601 is followed by step 603 wherein the estimate processor 405 generates estimated parametric data for a second set of audio channels in response to characteristics of the first set of audio channels. The estimated parametric data relates characteristics of the second set of audio channels to characteristics of the first set of audio channels.

Step 603 is followed by step 605 wherein the SAC decoding element 403 decodes the first signal in response to the estimated parametric data to generate the multi-channel signal comprising the second set of channels.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order.

Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A decoder for generating a multi channel audio signal, the decoder comprising:

a receiver for receiving a first signal comprising a first set of audio channels;

an estimator for generating estimated parametric data for a second set of audio channels in response to characteristics of the first set of audio channels; the estimated parametric data relating characteristics of the second set of audio channels to characteristics of the first set of audio channels, said estimator comprising a determiner for determining first parameter data for the first set of audio channels and a mapper for mapping the first parameter data to the estimated parameter data for the second set of audio channels, wherein the first parameter data comprises at least one inter-channel level difference value for at least two audio channels of the first set of audio signals; and a spatial audio decode for decoding the first signal in response to the estimated parametric data to generate the multi-channel audio signal comprising the second set of channels.

2. The decoder of claim 1 wherein the first signal comprises no parametric audio data related to the second set of channels.

3. The decoder of claim 1 wherein the first parameter data comprises at least one inter-channel correlation coefficient value for at least two audio channels of the first set of audio signals.

4. The decoder of claim 3 wherein the estimator comprises a direct mapper for directly mapping a set of at least one signal characteristic of the first set of audio channels for a time frequency tile to a corresponding value of parametric data for the second set of audio channels.

5. The decoder of claim 1 wherein the multi channel audio signal is a surround sound signal and the estimated parameter data comprises at least one parameter selected from the group consisting of:

an inter-channel level difference between a left-front and a left-surround channel of the second set of channels;

an inter-channel level difference between a right-front and a right-surround channel of the second set of channels;

an inter-channel correlation coefficient between a left-front and a left-surround channel of the second set of channels;

an inter-channel correlation coefficient between a right-front and a right-surround channel of the second set of channels;

a prediction coefficient for a center channel of the second set of audio channels; and an inter-channel level difference between a center channel and another channel of the second set of channels.

6. The decoder of claim 1 further comprising a generator for generating time frequency tiles; and wherein the estimator is arranged to generate the estimated parametric data for time frequency tiles.

7. The decoder of claim 1 wherein the spatial audio decoder is arranged to perform at least one matrix operation using parameters determined in response to the estimated parametric data.

8. The decoder of claim 1 further comprising an extractor for extracting parametric data for a second signal, and wherein the spatial audio decoder is operable to decode the first signal in response to the extracted parametric data.

9. The decoder of claim 1 further comprising a selector for selecting a decoding mode in response to a characteristic of the first signal.

10. The decoder of claim 1 wherein the first set of audio channels consists of two audio channels.

11. The decoder of claim 10 wherein the first signal is a matrix encoded surround sound signal.

12. The decoder of claim 11 further comprising a matrix-surround inversion matrix and a determiner for determining at least one coefficient of the matrix-surround inversion matrix in response to the estimated parametric data.

13. An audio playing device comprising a decoder according to claim 1.

14. A method of generating a multi channel audio signal, the method comprising:

receiving a first signal comprising a first set of audio channels;

generating estimated parametric data for a second set of audio channels in response to characteristics of the first set of audio channels; the estimated parametric data relating characteristics of the second set of audio channels to characteristics of the first set of audio channels, said generating estimated parametric data for the second set of audio channels comprising determining first parameter data for the first set of audio channels, and mapping the first parameter data to the estimated parameter data for the second set of audio channels, whereby the first parameter data comprises at least one inter-channel level difference value for at least two channels of the first set of audio signals; and decoding the first signal in response to the estimated parametric data to generate the multi-channel audio signal comprising the second set of channels.

15. A non-transitory storage medium having stored thereon a computer program product for executing the method of claim 14.

16. A receiver for generating a multi channel audio signal, the receiver comprising:

a first signal receiver for receiving a first signal comprising a first set of audio channels;

an estimator for generating estimated parametric data for a second set of audio channels in response to characteristics of the first set of audio channels; the estimated parametric data relating characteristics of the second set of audio channels to characteristics of the first set of audio channels, said estimator comprising a determiner for determining first parameter data for the first set of audio channels and a mapper for mapping the first parameter data to the estimated parameter data for the second set of audio channels, wherein the first parameter data comprises at least one inter-channel level difference value for at least two audio channels of the first set of audio signals; and a spatial audio decoder for decoding the first signal in response to the estimated parametric data to generate the multi-channel audio signal comprising the second set of channels.

17. A transmission system including:

an encoder for generating a first signal comprising a first set of audio channels by encoding a multi channel signal;

a transmitter for transmitting the first signal;

a first signal receiver for receiving the first signal;

an estimator for generating estimated parametric data for a second set of audio channels in response to characteristics of the first set of audio channels; the estimated parametric data relating characteristics of the second set of audio channels to characteristics of the first set of audio channels, said estimator being configured for determining first parameter data for the first set of audio channels and mapping the first parameter data to the estimated parameter data for the second set of audio channels, wherein the first parameter data comprises at least one inter-channel level difference value for at least two audio channels of the first set of audio signals; and a spatial audio decoder for decoding the first signal in response to the estimated parametric data to generate a decoded multi-channel audio signal comprising the second set of channels.

18. A method of transmitting and receiving an audio signal, the method comprising:

generating a first signal comprising a first set of audio channels by encoding a multi channel signal;

transmitting the first signal;

receiving the first signal ;

generating estimated parametric data for a second set of audio channels in response to characteristics of the first set of audio channels; the estimated parametric data relating characteristics of the second set of audio channels to characteristics of the first set of audio channels, said generating comprising determining first parameter data for the first set of audio channels and mapping the first parameter data to the estimated parameter data for the second set of audio channels, wherein the first parameter data comprises at least one inter-channel level difference value for at least two audio channels of the first set of audio signals; and decoding the first signal in response to the estimated parametric data to generate a decoded multi-channel audio signal comprising the second set of channels.

* * * * *